US006123050A

United States Patent [19]

Castaneda

[11] Patent Number: 6,123,050

[45] Date of Patent: Sep. 26, 2000

[54] SANITARY STAINLESS STEEL HEATING SYSTEM

[76] Inventor: Hector J. Castaneda, 10780 Standard Ave., Lynwood, Calif. 90262-2245

[21] Appl. No.: 09/409,901

[22] Filed: Oct. 5, 1999

Related U.S. Application Data

[60] Provisional application No. 60/103,056, Oct. 5, 1998.

[51] Int. Cl.[7] ..... F22B 5/04; F24H 1/20

[52] U.S. Cl. ..... 122/234; 122/13.01; 392/452; 392/455

[58] Field of Search ..... 122/2, 118, 119, 122/131, 234, 235.15, 13.01; 392/452, 453, 455, 457

[56] References Cited

U.S. PATENT DOCUMENTS

| | | | |
|---|---|---|---|
| 1,737,834 | 12/1929 | Eaton | 392/452 |
| 4,506,140 | 3/1985 | Armstrong | 392/453 |
| 4,777,347 | 10/1988 | Mottershead | 392/452 |

*Primary Examiner*—Denise L. Ferensic
*Assistant Examiner*—Gregory A. Wilson
*Attorney, Agent, or Firm*—Kelly Bauersfeld Lowry & Kelley, LLP

[57] ABSTRACT

A sanitary fluid heater includes a corrosion resistant stainless steel housing, a stainless steel cap securely positioned over an open end of the housing, and a heating element disposed within the housing. The cap defines an internal cavity which includes an internal wall having an aperture therethrough for receiving an end of the heating element which extends beyond the open end of the housing to form a corrosion resistant hermetic seal over the open end of the housing. Fluid contacting inner surfaces of the housing and the cap are polished smooth. In one embodiment, inlet and outlet fittings are attached to the housing to define, respectively, a fluid inlet and a fluid outlet. The inlet and outlet each have a sanitary fitting at an end thereof which faces a corresponding sanitary fitting of a respective fluid inlet or fluid outlet line. Gaskets placed between facing sanitary fittings and clamps form fluid-tight connections between the facing sanitary fittings. A plurality of such heaters may be fluidly interconnected to form a sanitary fluid heating system. In another embodiment, an immersion heater comprises a housing having an open end forming a sanitary fitting and a corrosion resistant cap having a sanitary fitting positioned over the open end of the housing and secured to the housing with a clamp similar to the first embodiment. The heater is placed into an open tank or inserted into a port designed to accommodate the heater in a fluid-tight connection.

20 Claims, 5 Drawing Sheets

SANITARY STAINLESS STEEL HEATING SYSTEM

This application claims priority from provisional application Ser. No. 60/103,056, filed Oct. 5, 1998.

BACKGROUND OF THE INVENTION

The present invention relates to heaters and heating systems. More particularly, the present invention relates to a heater used in ultra pure fluid heating systems which incorporates the use of sanitary fittings.

In the biomedical, medical, pharmaceutical and other process sensitive industries, there is a present need to heat ultra pure fluids, such as deionized water. There are already many conventional designs for fluid heating systems. One type of conventional system uses an elongated chamber surrounding an elongated heating element which extends along the longitudinal axis of the chamber. The system heats water or other fluids as the fluid flows through the chamber and around the heating elements of the system.

However, such conventional systems have several drawbacks. When heating fluids of this type, a major concern revolves around the fluids becoming contaminated by exposure to the environment of undesirable foreign media. Prior systems have used mechanical joints at the various points of connection of the system, including the fluid ingress and egress ports. Such mechanical joints include threaded, bolted and flanged joints. However, undesirable particle entrapment can occur in these joints. Thus, these mechanical joints must periodically be disassembled in order to remove the contaminants and clean the joints for future use.

Special tooling is often required in order to assemble and disassemble the mechanical joints. Moreover, the threads or sealing surface can become worn or damaged due to the repeated disassembly and assembly of the mechanical joints, causing a generally poor sealing surface and raising the concern of entry of contaminants into the fluid.

Many prior systems also utilize materials which are chemically reactive or corrosive. The internal surfaces of these systems may also have relatively rough interior surfaces. Aside from the purity concerns of the heated fluid, these materials and surfaces also decrease fluid handling and require additional maintenance.

Accordingly, there is a need for a novel ultra pure fluid heater and a related heating system which utilizes joints or fittings designed to prevent fluid contamination and which are easier to maintain and clean than prior mechanical joints. What is also needed is a heater which utilizes non-corrosive and highly polished materials to improve fluid handling and purity as well as increasing corrosion resistance. The present invention fulfills these needs and provides other related advantages.

SUMMARY OF THE INVENTION

The present invention resides in a sanitary fluid heater used in fluid heating systems which incorporates the use of sanitary fittings and clamps to prevent contamination of the fluid to be heated and which also facilitate maintenance and cleaning.

The sanitary fluid heater is generally comprised of a corrosion resistant housing having a longitudinal axis and an open end forming a sanitary fitting, a corrosion resistant cap attached to the open end of the housing, and a heating element which is disposed parallel to the longitudinal axis within the housing and which extends beyond the open end thereof. The housing and cap are comprised of stainless steel having inner surfaces which are polished smooth.

The corrosion resistant cap defines an inner cavity which includes an inner wall disposed within the inner cavity. The wall includes an aperture therethrough for receiving the end of the heating element extending beyond the open end of the housing for external electrical connection. The heating element is typically surrounded by a corrosion resistant sheath. A plurality of heating elements may also be used. The inner cavity of the cap is further filled with sealant, usually a corrosion resistant epoxy resin to form a hermetic seal.

In one embodiment, an inlet fitting and an outlet fitting are attached to the housing to define a fluid inlet and an outlet, respectively. The inlet and outlet each have a sanitary fitting at an end thereof. Fluid inlet and outlet supply lines are provided which each have a sanitary fitting corresponding to the sanitary fittings of the respective inlet and outlet fittings. Clamps are provided to form fluid-tight connections between the sanitary fittings of the inlet and outlet fittings and the corresponding sanitary fittings of the inlet and outlet fluid supply lines for the fluid heater. A sealing gasket may also be disposed within each clamp between facing sanitary fittings. A drain at a base of the housing forms a sanitary fitting at an end thereof. The drain's sanitary fitting is disposed within a clamp which, together with a plug, closes the drain to fluid flow. All of the sanitary fittings are welded, usually by an orbital weld, in place.

In another embodiment, an immersion or cartridge-type heater comprises a housing having an open end forming a sanitary fitting and a corrosion resistant cap having a sanitary fitting positioned over the open end of the housing and secured to the housing with a clamp similar to the first embodiment. The heater is placed into an open tank or inserted into a port designed to accommodate the heater in a fluid-tight connection.

In use, the heaters of the first embodiment can be assembled in series and interlinked to appropriate plumbing and electrical controls to provide an effective quick-response heating system. Fluid circulates between the fluid inlet and outlets and is heated as it passes over the heating elements. Any number of heaters can be connected in series to provide varying degrees of heating capacity.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
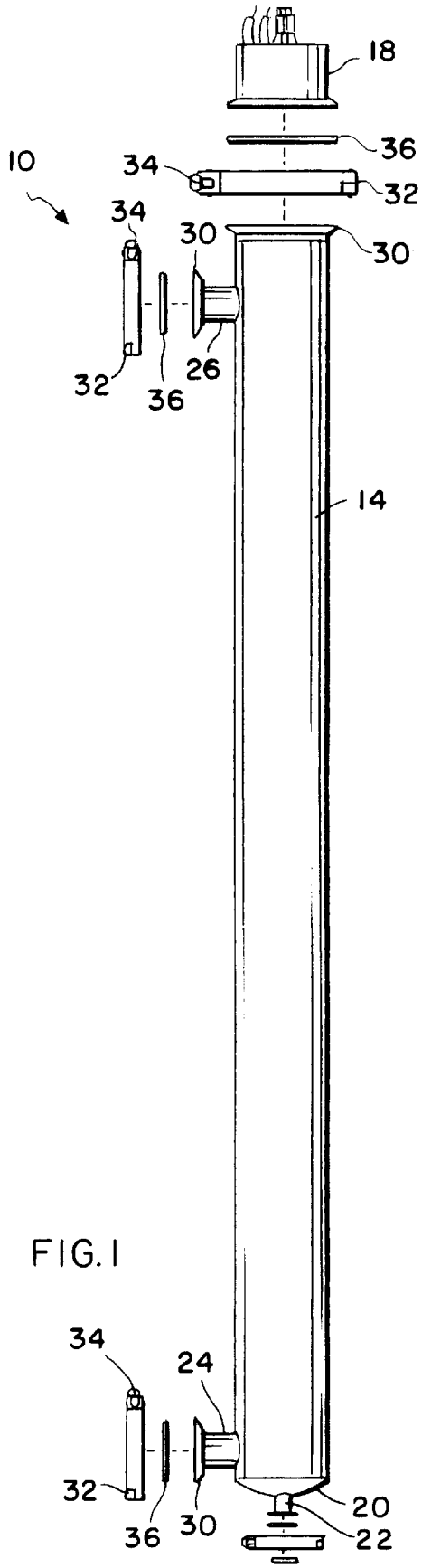
FIG. 1 is an exploded elevational view of a sanitary heater embodying the present invention.
Figure 2:
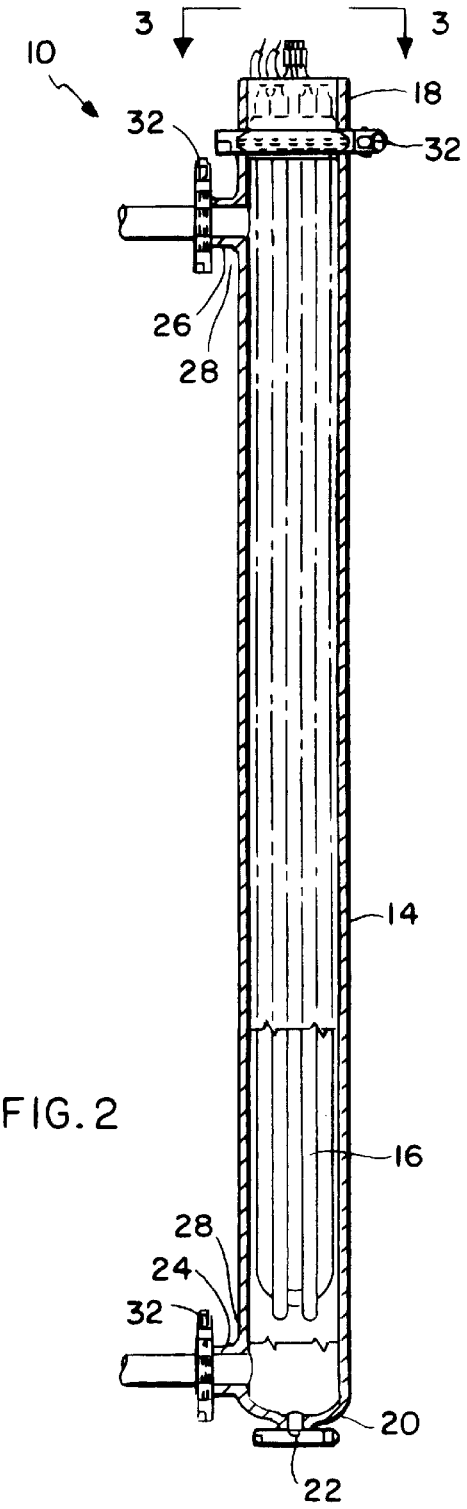
FIG. 2 is a partial cross-sectional view of the sanitary heater of FIG. 1.
Figure 5:
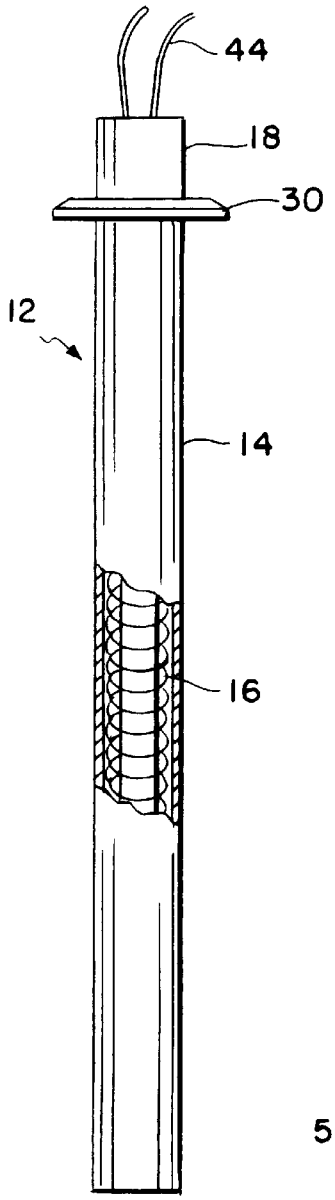
FIG. 5 is an elevational and partially cross-sectional view of an immersion-heater embodying the present invention, illustrating a heating element within the housing.
Figure 6:
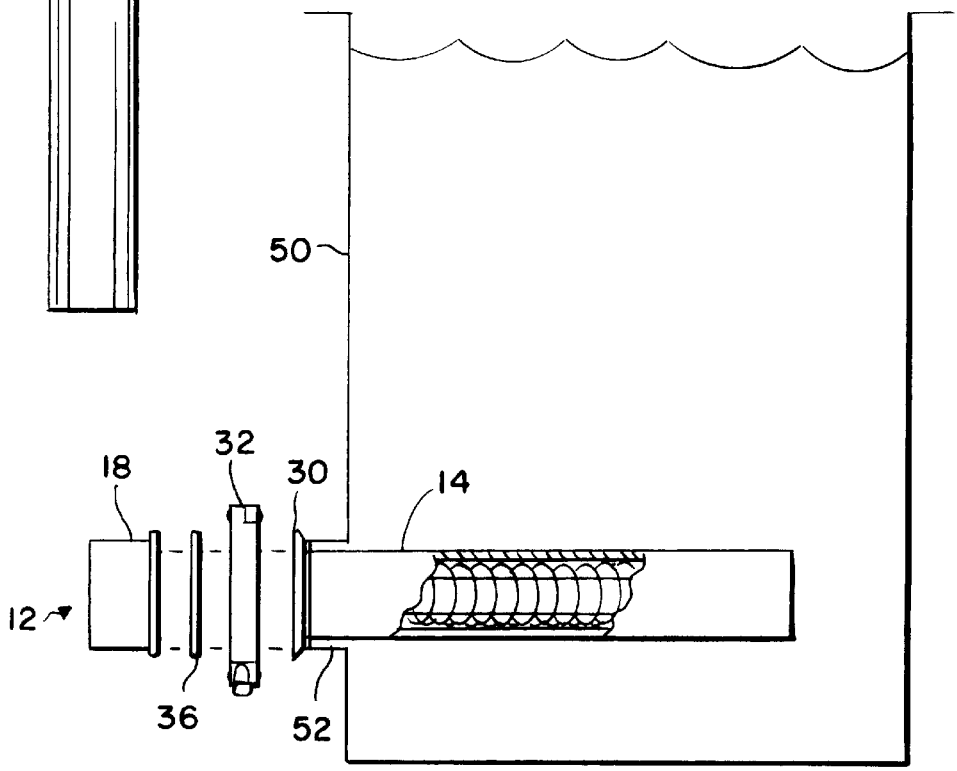
FIG. 6 is a partially exploded and cross-sectional view of the heater of FIG. 5, immersed in a tank of fluid.

As shown in the drawings for purposes of illustration, the present invention is concerned with a sanitary fluid heater used in sanitary fluid heating systems and generally referred to in FIGS. 1 and 2 by the reference number 10, and in FIGS. 5 and 6 by the reference number 12. Although such systems are typically used to heat deionized water, it is to be understood that the sanitary fluid heaters 10 and 12 of the present invention can also be used to heat other fluids in industries where fluid purification is a concern.

With reference to FIGS. 1 and 2, the heater 10 is generally comprised of a cylindrical housing 14, a series of heating elements 16 disposed within the housing, and a housing cap 18 designed to provide access to the interior of the housing 14 and the heating elements 16. The housing 14 is an elongated tube preferably constructed of a non-corrosive material, such as 316L stainless steel. The fluid contacting inner surfaces of the housing 14 is polished to approximately 20 Ra, measured in roughness average per micro inches.

The housing 14 has a metal bowl also formed of 316L stainless steel welded to the bottom of the housing 14 to form a base 20. A drain 22 is formed through the base 20 in the event the housing is to be flushed of internal fluid. An inlet fitting 24 allowing the ingress of fluid into the housing 14, and an outlet fitting 26 for the egress of fluid from the housing 14, are formed through the wall of the housing 14. Typically, the inlet fitting 24 is formed near the bottom of the housing 14 while the outlet fitting 26 is formed near the top of the housing 14, although it is to be understood that the placement of each is not limited to this design.

The drain 22, the inlet fitting 24 and the outlet fitting 26 are all welded to the housing 14 to form a hermetic seal between each and the housing 14. Preferably the weld 28 is a high quality orbital weld which has an internal surface quality of approximately the same smoothness as the interior surface of the housing 14.

Fluid inlet and outlet lines, each having sanitary fittings at its end, are connected to the inlet and outlet fittings 24 and 26, respectively, to provide water circulation. The inlet and outlet fittings 24 and 26 are configured at distal ends thereof to form smooth surface sanitary fittings 30 which accept mating clamps 32 for clamping the inlet and outlet lines to the inlet and outlet fittings 24 and 26. The clamps 32 are typically tri-clover or tri-clamp in design and can be tightened to the sanitary fitting 30 with the use of a wing nut 34. The smooth mating surfaces of the sanitary fittings 30 and the clamp 32 form a desirable seal. A gasket 36, preferably a Chemraz O-ring or the like, may be interposed between facing sanitary fittings 30 to further seal the inlet and outlet fittings 24 and 26 from outside contaminants. The sanitary fittings 30 and clamps 32 are typically composed of stainless steel which is corrosion and chemically resistant to the fluids used in the aforementioned industries.

Use of the sanitary fittings 30 and clamps 32 prevent problems associated with prior heating systems. No special tools are needed to disassemble, assemble, or even tighten the clamp 32 to the sanitary fitting 30. As there is no mechanical seal, as with threaded or bolted ports, wear and damage are significantly reduced. Furthermore, a very good sealing surface is provided when the clamp 32 is fully tightened to the sanitary fitting 30, resulting in the virtual elimination of contaminant entrapment or entry into the fluid. It is also much easier to clean the connection points due to the smooth surfaces of the sanitary fittings 30.

A sanitary fitting 30 is also welded to or otherwise formed at the open top of the cylindrical housing 14 to which the cap 18 attaches. The cap 18 is constructed of a length of 316L stainless steel tubing with a sanitary fitting 30 welded to the bottom of the cap 18. The sanitary fittings 30 of the housing 14 and the cap 18 are aligned and a clamp 32 securely seals the cap 18 to the housing 14, in the same manner as detailed above. Once again, a gasket 36 in the form of an O-ring is used to completely seal the connection.

Figure 3:
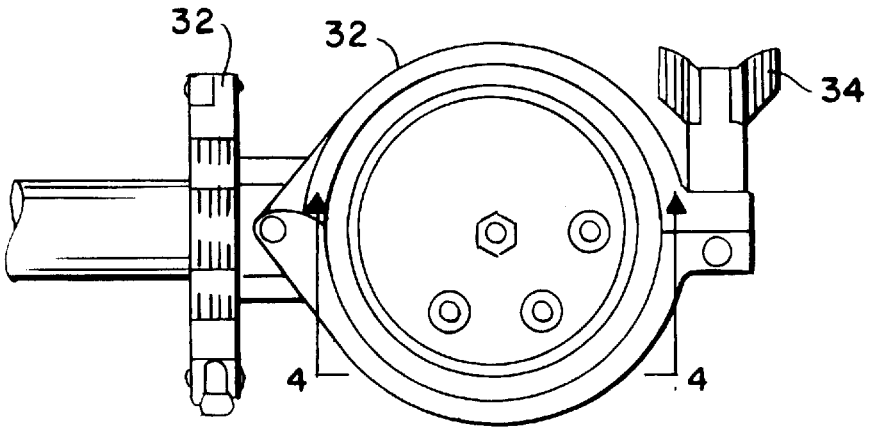
FIG. 3 is a top plan view of the heater of FIGS. 1 and 2, taken generally along the line 3—3 of FIG. 2, illustrating external electrical connections and a sanitary clamp.
Figure 4:
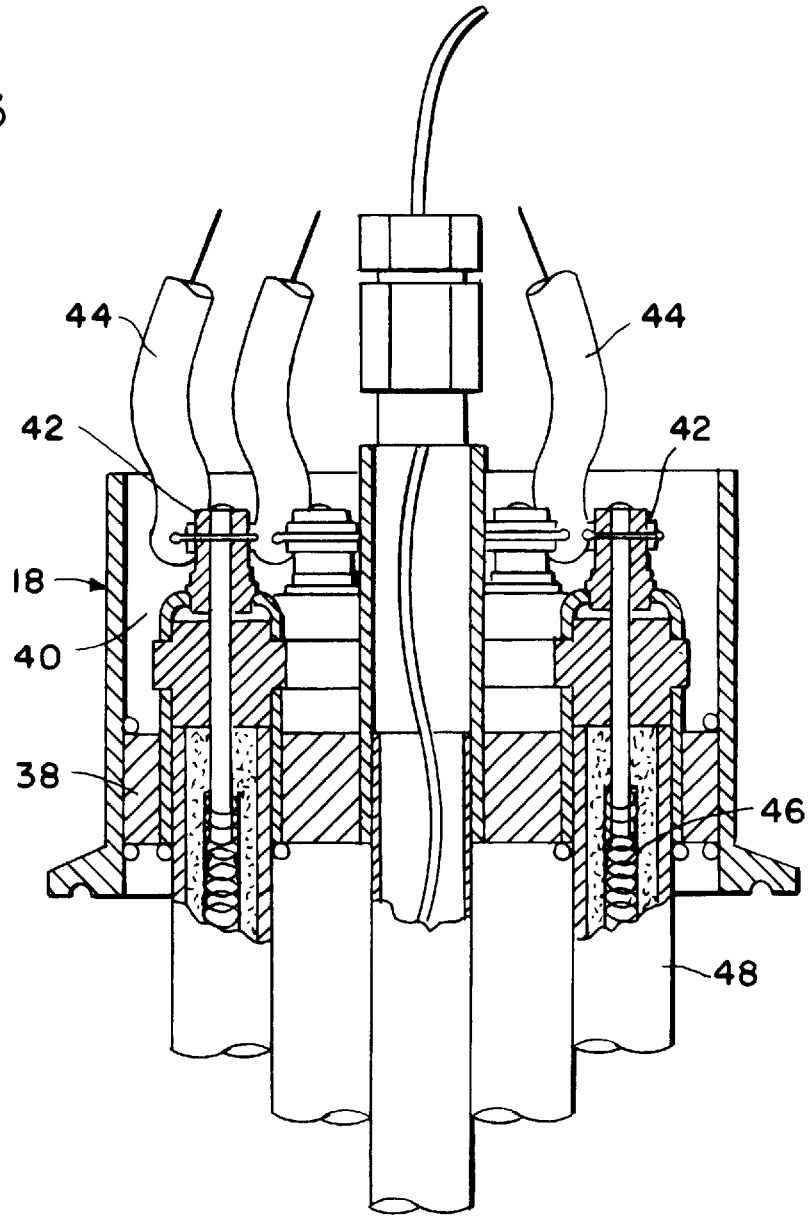
FIG. 4 is a fragmented and partial cross-sectional view of the cap taken generally along line 4—4 of FIG. 3, illustrating heating elements extending through an inner cavity thereof to external electrical connections.

Referring now to FIGS. 3 and 4, inside the cap 18 is a plate of 316L stainless steel welded into place to form an inner wall 38. The wall 38 divides the inner cavity 40 into upper and a lower sections and acts to form a hermetic seal. Attached to the cap 18 are the heating elements 16 which penetrate through the pre-drilled holes in the wall 38 into the inner cavity 40 of the cap 18. The heating elements 16 are secured into place by being welded to the wall 38 so that the lead ends 42 are on the upper external side of the wall 38. The lead ends 42 may be bussed in a 3-phase configuration or in a direct wiring scenario before external lead wires 44 are attached. After the lead wires 44 are attached the entire wiring assembly on the upper section of the interior cavity 40 is sealed in an epoxy resin which is resistant to corrosives. The hermetic sealant and the dividing wall 38 protects the attachment of the lead wires 44 from exposure to corrosive fluids.

The heating elements 16 extend from the cap 18 and into the housing 14 generally along the longitudinal axis. The heating elements 16 are generally comprised of a resistance wire 46 to heat the fluid in question. The resistance wire 46 is encased in a sheath 48 of corrosion resistant metal alloy such as, but not limited to, grade 316L stainless steel, Incoloy 800®, or Hastelloy®. The sheath 48 shields the resistance wire 46 from exposure to the potentially corrosive fluid.

The fluid exposed interior portions of the heater 10 consist of the lower section of the inner cavity 40, the surfaces of the heating element sheaths 48, the inlet and outlet ports 24 and 26, and the interior portion of the cylindrical housing 14. For simplicity, these surfaces shall be referred to collectively as the "wetted surface". The wetted surface of each heater 10 has a polished finish with a surface quality of approximately 20 Ra (roughness average in micro inches) maximum. This surface quality is achieved by a mechanical polishing. If the need dictates, electropolishing can also be performed on the wetted surface to improve the surface quality. A final step involves the passivation of the wetted surface so as to protect it from corrosion and prevent contamination of the fluid from the heater 10.

The same principles described above can also be implemented in tank and immersion-type heaters 12, such as the cartridge-type heater illustrated in FIGS. 5 and 6. The heater 12 also comprises a housing 14 having a cap 18 configured and attached to the housing 14 with a sanitary fitting 30 and clamp 32 as described above. The resistant wire 46 of the heating element may be unsheathed with the outer surface of the housing 14 exposed to the fluid, or the resistant wire 46 may be sheathed and the fluid allowed to enter the housing 14 for heating. The heater 12 may be placed in a top of an open tank 50, or inserted into a fitting 52 of the tank designed to accommodate the heater 12. Either the heater 12 and/or the fitting 52 may include a sanitary fitting 30 for completing a hermetic and contaminant free seal.

Although two embodiments of the heater 10 and 12 have been illustrated and described, the principles of the invention can also be implemented in any number of stainless steel encapsulated resistance heating systems including, but not limited to, bar, cartridge, or strip form. The assembly of these types of heating systems follows a similar pattern as that of the cylindrical heaters, with the internal bussing and sealing of the heaters, and lead being supplied at the end of the heater outside and away from fluid exposure.

Heaters, particularly those illustrated in FIGS. 1 and 2, can be assembled in series and wired to appropriate controls to provide an effective quick-response heating system. Interconnecting the heaters 10 is accomplished through the use of sanitary fittings 30, clamps 32 and tubing in the same fashion as described above. The fluid is typically heated when it enters through the inlet fitting 24 of the heater 10, circulates past the heating elements 14, and then exits through the outlet fitting 26. Any number of heaters 10 can be connected in series to provide varying degrees of heating capacity.

Figure 7:
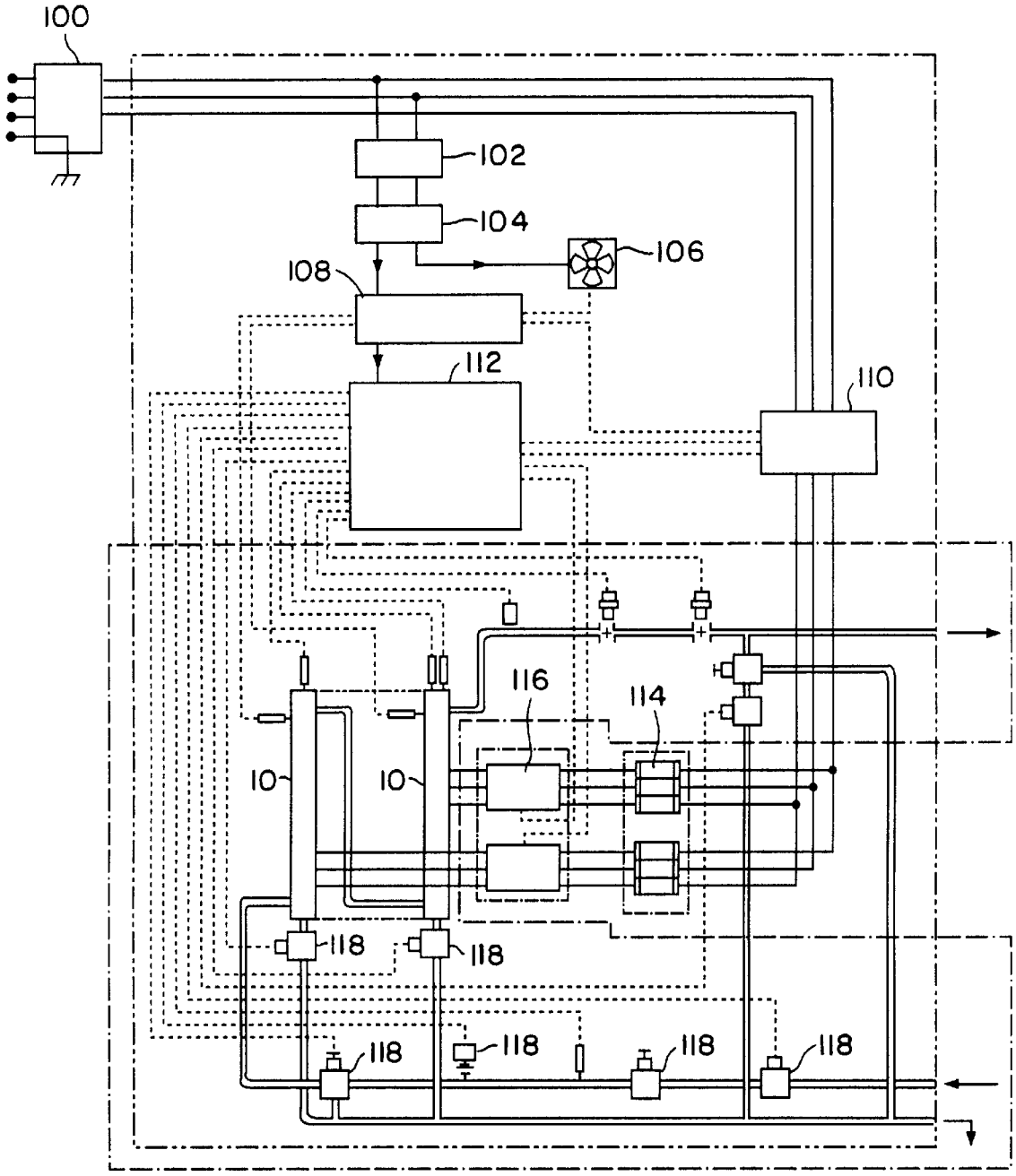
FIG. 7 is an exemplary flow and logic schematic of a system utilizing the fluid heaters of the present invention.
Figure 8:
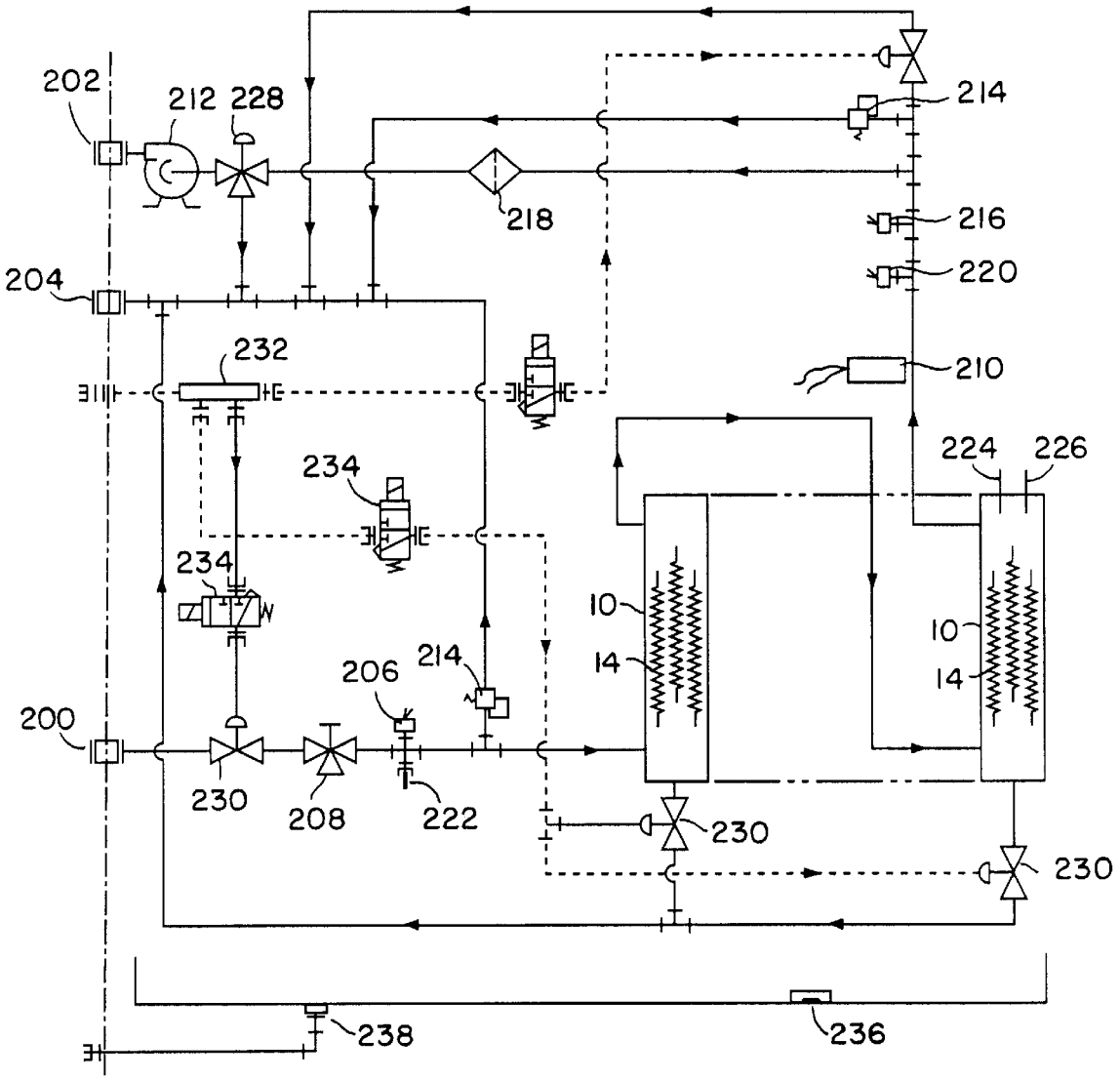
FIG. 8 is an exemplary plumbing logic schematic of a system utilizing the fluid heaters of the present invention.

The electrical control flow logic of the completed system is illustrated in FIG. 7, with double parallel lines indicating pipes, single lines indicating electrical wires, and dashed lines indicating signal lines. The system includes an incoming power supply 100 for the heating system. A circuit breaker 102 is provided between the power supply 100 and the system in the event of over-amperage of the system. A voltage transformer 104 lowers the incoming voltage to an appropriate amount for the control circuit. A fan 106 is strategically placed to cool the various electrical components of the system. The voltage passes through an emergency relay 108 before passing to a master contact 110 designed to provide power to the heaters 10 and a system temperature controller 112 which interfaces with various sensor and controls to alter the power supplied to the heaters 10. Fuses 114 are built into the system which provide protection from over-amperage of the heaters 10. Solid state relays 116 switch power to the heaters 10. Item 118 encompasses plumbing components including air and pressure regulated valves which are more fully detailed in the following plumbing schematic of FIG. 8.

The plumbing logic of the completed system includes a fluid inlet 200 from which the heaters 10 receive the fluid to be heated. The heated fluid eventually exits through an outlet 202, and if necessary through a drain 204. A pressure transducer 206 monitors the fluid pressure within the heating system and pressure regulator 208 prevent over-pressurized fluid from entering the system. A liquid level sensor 210 ensures that there is a safe level of fluid maintained within the system in relation to the power that is generated. A pump 212 is designed to direct the fluid to locations above current fluid levels. Pressure relief valves 214 are provided and designed to protect the system from excessive pressure.

A resistivity sensor 216 is designed to check the purity level of the fluid. If necessary a filtration system 218 may be implemented for providing further fluid filtration. A flow sensor 220 measures the flow to the resistivity sensor 216 and supplies the heating system controls with information so as to allow the controls to apply power to the heating system as needed. An input thermocouple 222 measures the temperature of the fluid as it enters the system. This measurement is then employed to calculate the amount of power to be applied to the heating system. Thermocouple 224 and thermofuse 226 are designed for checking the process temperature of the fluid being heated so as not to overheat the heating elements 14. A temperature relief valve 228 is designed to provide protection against over-temperature fluid leaving the system.

Air operated valves 230 provide redirection of the fluid to alternate paths in the event of a system failure. Air is supplied to all air operated components by way of an air distribution manifold 232 which is controlled by solenoid valves 234. A leak detector 236 is provided for detecting the presence of fluid outside the fluid path. A drip pan 238 collects fluid in the event of a leak.

Although several embodiments have been described in detail for purposes of illustration, various modifications may be made without departing from the scope and spirit of the invention. Accordingly, the invention is not to be limited, except as by the appended claims.

What is claimed is:

1. A sanitary fluid heater, comprising:

an elongated corrosion resistant housing having an open end forming a sanitary fitting;

a heating element disposed within the housing having an end thereof extending beyond the open end of the housing;

a corrosion resistant cap positioned over the open end of the housing, the cap defining an internal cavity and including an internal wall disposed within the internal cavity, the wall including an aperture therethrough for receiving the end of the heating element extending beyond the open end of the housing to form a corrosion resistant hermetic seal over the open end of the housing, and a sanitary fitting at an end thereof; and a clamp for forming a fluid tight connection between the sanitary fitting of the cap and the sanitary fitting defining the open end of the housing.

2. The heater of claim 1, including a drain at a base of the housing, the drain forming a sanitary fitting at an end thereof disposed within a clamp which, together with a plug, closes the drain to fluid flow therethrough.

3. The heater of claim 1, including an inlet fitting attached to the housing defining a fluid inlet and having a sanitary fitting at an end thereof, and an outlet fitting attached to the housing defining a fluid outlet and having a sanitary fitting at an end thereof.

4. The heater of claim 3, wherein the sanitary fittings are orbitally welded in place.

5. The heater of claim 3, including a fluid inlet line having sanitary fitting at an end thereof secured to the fluid inlet by a removable clamp, and a fluid outlet line having a sanitary fitting at an end thereof secured to the fluid outlet by another removable clamp.

6. The heater of claim 5, including a sealing gasket disposed within each clamp between facing sanitary fittings.

7. The heater of claim 1, wherein a portion of the inner cavity of the corrosion resistant cap is filled with sealant to form a hermetic seal.

8. The heater of claim 7, wherein the sealant comprises a corrosion resistant epoxy resin.

9. The heater of claim 1, wherein the housing and the cap are comprised of stainless steel.

10. The heater of claim 9, wherein inner surfaces of the housing and the cap which are exposed to heated fluid are polished smooth.

11. The heater of claim 1, including a corrosion resistant sheath surrounding the heating element.

12. A sanitary fluid heater, comprising:

an elongated corrosion resistant housing having an open end forming a sanitary fitting;

an inlet fitting attached to the housing defining a fluid inlet and having a sanitary fitting at an end thereof;

an outlet fitting attached to the housing defining a fluid outlet and having a sanitary fitting at an end thereof;

a heating element disposed within the housing and having an end thereof extending beyond the open end of the housing;

a corrosion resistant cap positioned over the open end of the housing, the cap defining an internal cavity and including an internal wall disposed within the internal cavity, the wall including an aperture therethrough for receiving the end of the heating element extending beyond the open end of the housing to form a corrosion resistant hermetic seal over the open end of the housing, and a sanitary fitting at an end thereof; and a clamp for forming a fluid tight connection between the sanitary fitting of the cap and the sanitary fitting defining the open end of the housing.

13. The heater of claim 12, including a fluid inlet line having sanitary fitting at an end thereof secured to the fluid inlet by a removable clamp, and a fluid outlet line having a sanitary fitting at an end thereof secured to the fluid outlet by another removable clamp.

14. The heater of claim 13, including a sealing gasket disposed within each clamp between facing sanitary fittings.

15. The heater of claim 12, including a drain at a base of the housing, the drain forming a sanitary fitting at an end thereof disposed within a clamp which, together with a plug, closes the drain to fluid flow therethrough.

16. The heater of claim 12, wherein a portion of the inner cavity of the corrosion resistant cap is filled with corrosion resistant epoxy resin sealant to form a hermetic seal.

17. The heater of claim 12, wherein the housing and cap are comprised of stainless steel having inner polished surfaces.

18. A sanitary fluid heater, comprising:

an elongated corrosion resistant housing having a longitudinal axis extending therethrough and an open end forming a sanitary fitting;

an inlet fitting attached to the housing defining a fluid inlet and having a sanitary fitting at an end thereof;

a fluid inlet line having a sanitary fitting at an end thereof secured to the fluid inlet by a removable clamp;

an outlet fitting attached to the housing defining a fluid outlet and having a sanitary fitting at an end thereof;

a fluid outlet line having a sanitary fitting at an end thereof secured to the fluid outlet by a removable clamp;

a drain at a base of the housing having a sanitary fitting and a removable clamp at an end thereof;

a heating element disposed within the housing parallel to the longitudinal axis and having an end thereof extending beyond the open end of the housing;

a corrosion resistant cap positioned over the open end of the housing, the cap defining an internal cavity and including an internal wall disposed within the cavity, the wall including an aperture therethrough for receiving the end of the heating element extending beyond the open end of the housing to form a corrosion resistant hermetic seal over the open end of the housing, and a sanitary fitting at an end thereof; and a clamp for forming a fluid tight connection between the sanitary fitting of the cap and the sanitary fitting defining the open end of the housing.

19. The heater of claim 18, including a sealing gasket disposed within each clamp between facing sanitary fittings for forming fluid-tight connections therebetween.

20. The heater of claim 18, wherein a portion of the inner cavity of the corrosion resistant cap is filled with a corrosion resistant epoxy resin sealant to form a hermetic seal.

* * * * *